US005167263A

United States Patent [19]

Kelen et al.

[11] Patent Number: 5,167,263

[45] Date of Patent: Dec. 1, 1992

[54] INDUSTRIAL HIGH STRENGTH WEBBING

[76] Inventors: Steven I. Kelen, 4560 Pacific Blvd., Los Angeles, Calif. 90058; David L. Woods, 3253 Rosewood Ave., Mar Vista, Calif. 90066

[21] Appl. No.: 777,085

[22] Filed: Oct. 16, 1991

[51] Int. Cl.[5] ..... D03D 13/00; D03D 15/00

[52] U.S. Cl. ..... 139/383 R; 139/408; 139/22; 139/432; 428/193

[58] Field of Search ..... 139/383 R, 425 A, 408, 139/22, 431, 432; 428/193, 225; 297/468

[56] References Cited

U.S. PATENT DOCUMENTS 4,660,605 4/1987 Koch ..... 139/383 R 4,750,529 6/1988 Watanabe ..... 139/383 R 4,800,929 1/1989 Watanabe ..... 139/383 R 4,981,161 1/1991 Pickering et al. ..... 139/383 R

*Primary Examiner*—Andrew M. Falik

*Attorney, Agent, or Firm*—Edgar W. Averill, Jr.

[57] ABSTRACT

A multi-layer industrial type woven webbing having a multiple weave construction has at least one warp end of polyamid yarn adjacent both of the selvage edges of both the upper layer of fabric and the lower layer of fabric to provide greater toughness at the edges of the webbing. Further toughness of the edges is provided by additionally adding two or more warp ends of polyamid monofilament at each selvage edge of each fabric layer.

4 Claims, 4 Drawing Sheets

INDUSTRIAL HIGH STRENGTH WEBBING

BACKGROUND OF THE INVENTION

The invention is weaving, and the invention relates more particularly to the weaving of medium or heavy weight industrial webbing.

Medium or heavy weight industrial webbing is widely used, for instance, for truckload restraint systems, container tie downs, and other relatively high strength applications. Such webbings are typically woven in a double or multiple weave construction having an upper layer of fabric and a lower layer of fabric. The two or more layers are, of course, joined by many binders and further preferably include an inner layer of stuffer yarns.

Typically, medium or heavy weight industrial webbing is woven from synthetic multifilament yarn. While polypropylene is used when high strength is not necessary, high strength applications typically use nylon (polyamid) or polyester. Both nylon and polyester yarns have very high tenacity. Nylon yarn, however, because of its superior elongation actually requires more work to break. Polyester, because it has less elongation is beneficial since its elongation under load is less.

Various attempts have been made to strengthen industrial webbing. The Hammersla U.S. Pat. No. 4,856,837 utilizes vinyl coated yarns at the selvage edges of cargo slings. Ogata U.S. Pat. No. 4,600,626 shows a seat belt webbing which utilizes a first weft thread having a low bending stiffness and a second weft thread having a high bending stiffness. The Pickering et al. U.S. Pat. No. 4,981,161 shows a seat belt webbing having a soft, round edge. A combination of a multifilament yarn and a monofilament yarn is used as the filling or weft yarn. The Johnson U.S. Pat. No. 4,052,095 shows a web sling laminated with chloroprene rubber. The sides of the web are also covered with an elastomer. The Taki sling belt, U.S. Pat. No. 4,209,044, utilizes a sheath of polyamide filament yarns, and the face side of the belt is thicker than the back side.

While various modifications have been made for particular applications, there is a need to improve the strength of medium or heavy weight industrial webbings without adding substantial cost to the webbing.

SUMMARY OF THE INVENTION

It is an object of the present invention to provide medium or heavy weight industrial webbings having improved edge toughness.

The present invention is for an improved webbing of the type having double weave construction, having an upper layer of fabric and a lower layer of fabric, a first selvage edge and a second selvage edge and having a plurality of filling of yarns. The layers of fabric are fabricated from polyester and have polyester binding yarns joining the upper and lower layers. The improvement of the present invention comprises at least one warp end of nylon yarn adjacent the first and second selvage edges of the upper layer of fabric and of the lower layer of fabric to provide greater toughness at the edges. Preferably, there are two or more nylon yarns at both edges of both the upper and lower layers of fabrics to provide a total of eight or more nylon yarn warp ends. A further improvement is provided by including one or more monofilament warp ends at each selvage edge at each layer of fabric to reduce the tendency of fraying. The method of forming the above webbings also is a part of the present invention.

DESCRIPTION OF THE PREFERRED EMBODIMENTS

Figures 1, 2, 3:
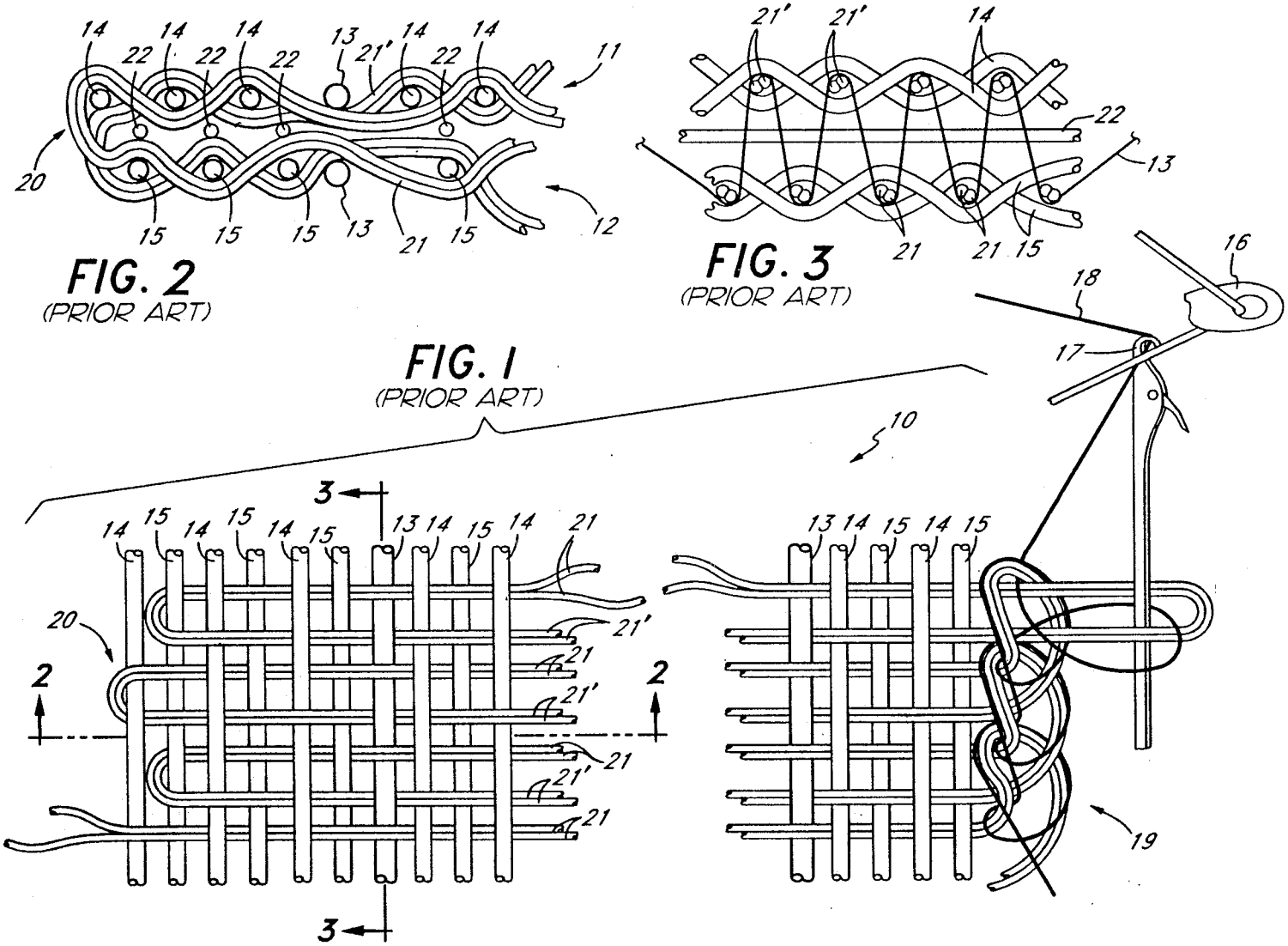
FIG. 3 (PRIOR ART)
FIG. 2 (PRIOR ART)
FIG. 1 (PRIOR ART)
FIG. 1 is a plan view of a prior art double plain weave webbing with stuffers and binders.
FIG. 2 is a cross-sectional view taken along line 2—2 of FIG. 1.
FIG. 3 is a cross-sectional view taken along line 3—3 of FIG. 1.

A prior art portion of a webbing is shown in FIG. 1 and indicated generally by reference character 10. Webbing 10 is of the type woven on a needle loom and is a double layer plain weave webbing including binders. A cross-sectional view of the left- hand portion taken along line 2—2 of FIG. 1 is shown in FIG. 2 where it can be seen that this portion of the woven webbing has an upper body fabric 11 and a lower body fabric 12 held together by a binder 13. The warp ends in upper fabric 11 are indicated by reference character 14 and those in lower fabric 12 are indicated by reference character 15.

In a needle loom, the filling, or weft yarns, are double since the filling needle 16 is brought across the width of fabric and is caught by latch needle 17 and together with a lock stitch 18 forms a double-locked knitted selvage 19. The left side of the webbing, as shown in FIG. 1, comprises a woven selvage 20, and the filling of lower fabric 12 is indicated by reference character 21, and that of upper fabric 11 is indicated by reference character 21'. A plurality of stuffer yarns 22 are held in each weave group, a weave group being the tubular member between binders or between binder 13 and woven selvage 20.

Webbings of the construction shown in FIGS. 1 through 3 are commonly used for relatively high strength applications such as truck load restraint systems and container tie downs. When the yarn used in the webbing is made from polyester, a 4" wide webbing will withstand a pull of about 20,000 pounds before breaking. However, when the webbing is tightened over a sharp, metal corner, some of the yarns can be cut.

Figure 4:
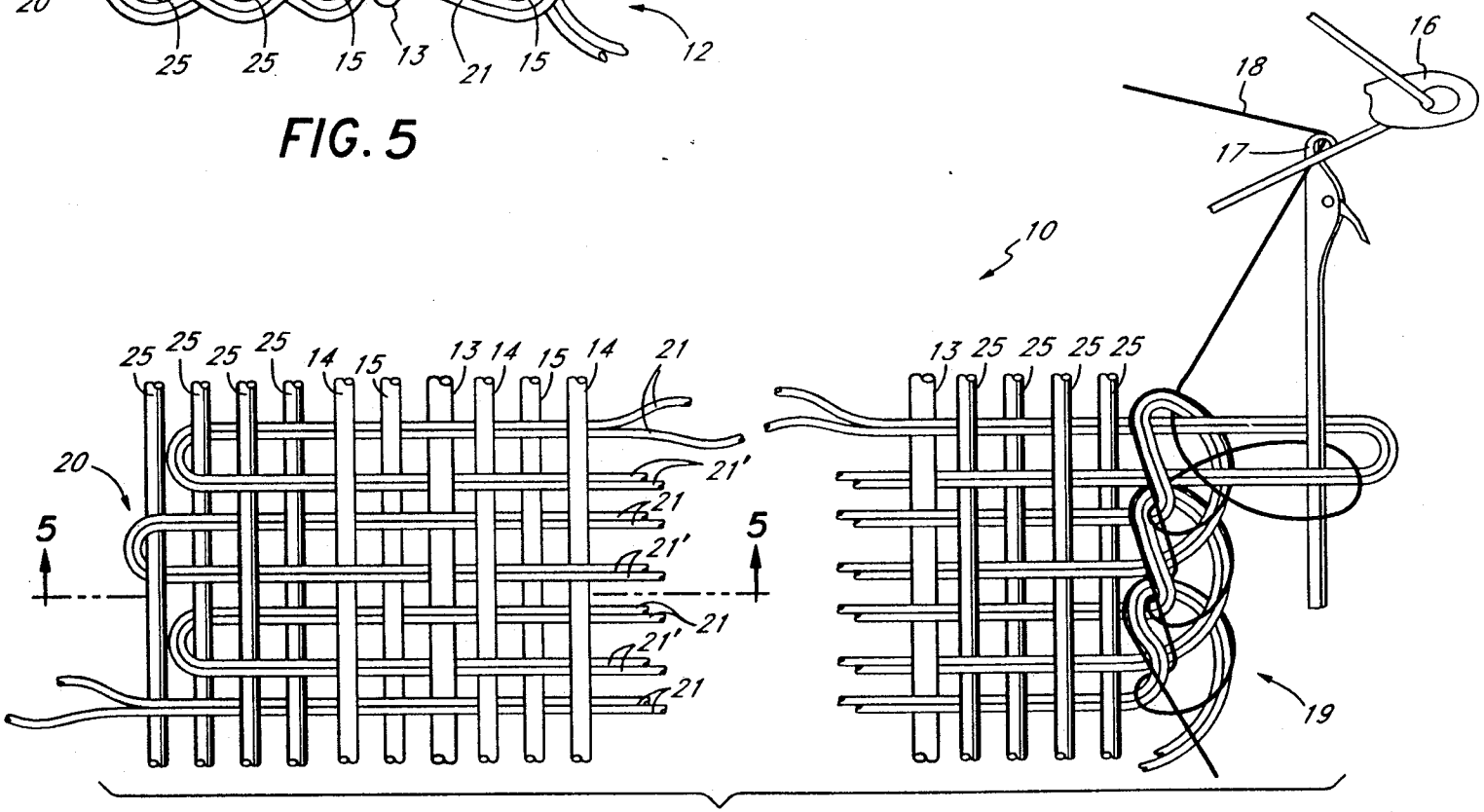
FIG. 4 is a plan view of a double plain weave webbing with stuffers and binders and utilizing the nylon warp ends of the present invention.
Figure 5:
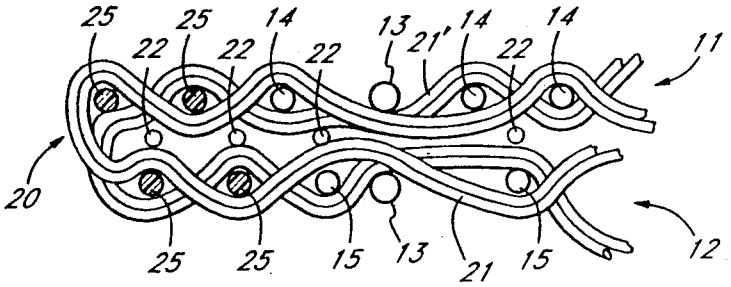
FIG. 5 is a cross-sectional view taken along line 5—5 of FIG. 4.
Figure 6:
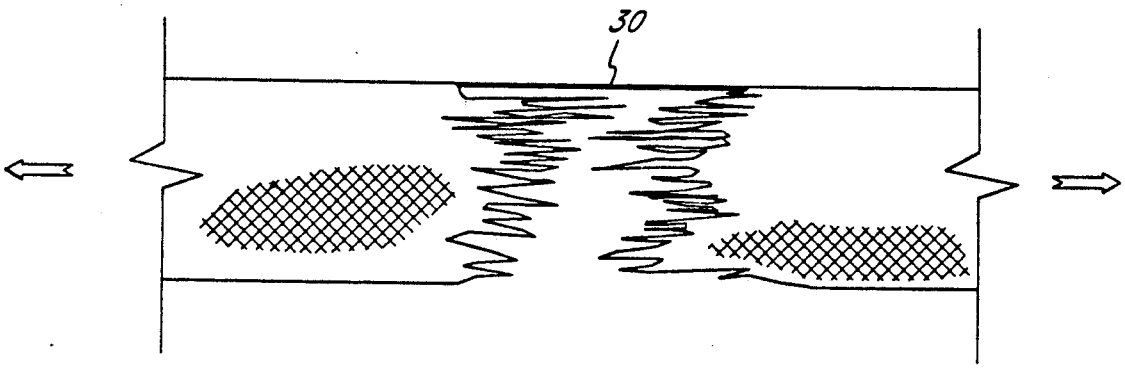
FIG. 6 is a front view of a length of the webbing of FIG. 4 during a tensile testing operation.
Figure 7:
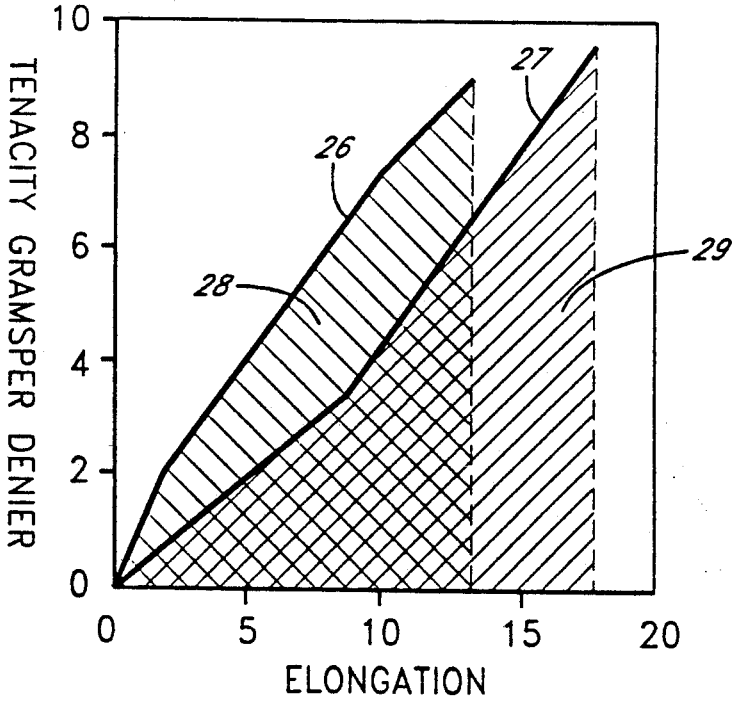
FIG. 7 is a graph of tenacity versus elongation for nylon and polyester.

It has been discovered that by substituting several of the polyester warp ends at the selvage edges of the body fabric with nylon, such as nylon 6 or nylon 6.6, that the webbing will have more durable edges which require more work to break by the same magnitude of force. For instance, in FIGS. 4 and 5, warp ends 25 are made from nylon yarn. Turning now to the graph of FIG. 7, it can be seen that the upper curve 26 represents the curve of polyester showing tenacity per elongation percent, and the right-hand curve 27 shows the same for nylon 6. If the force is measured in pounds, and the displacement is measured in inches, then the work done as a yarn is stretched equals the force times the displacement. For instance, if for a nylon webbing and a polyester webbing, approximately 20,500 pounds is required to break the webbing, the nylon webbing will elongate more before break and thus the amount of work done in breaking the nylon is greater than the amount of work done in breaking the polyester. Returning to the graph of FIG. 7, the work done is represented by the area under the two curves. The area under the polyester curve 26 is indicated by reference character 28 and is not as great as the area 29 under the nylon curve 27. Thus if a length of webbing has nylon edges, the edges of the webbing of FIGS. 4 and 5 will require more work to break. As shown in FIG. 6, a length of webbing made according to the drawings of FIGS. 4 and 5 containing four nylon yarns along each selvage edge was subjected to a tensile test to break. It can be seen that a nylon yarn 30 was the last to break. FIG. 6 was drawn from a photograph of a length of webbing in a testing machine.

While a plurality of nylon yarns at each selvage edge is preferable, even one yarn in the upper fabric and one yarn in the lower fabric along each selvage edge is beneficial, with two or more yarns in each of these four positions being preferred.

Figures 8, 9, 10:
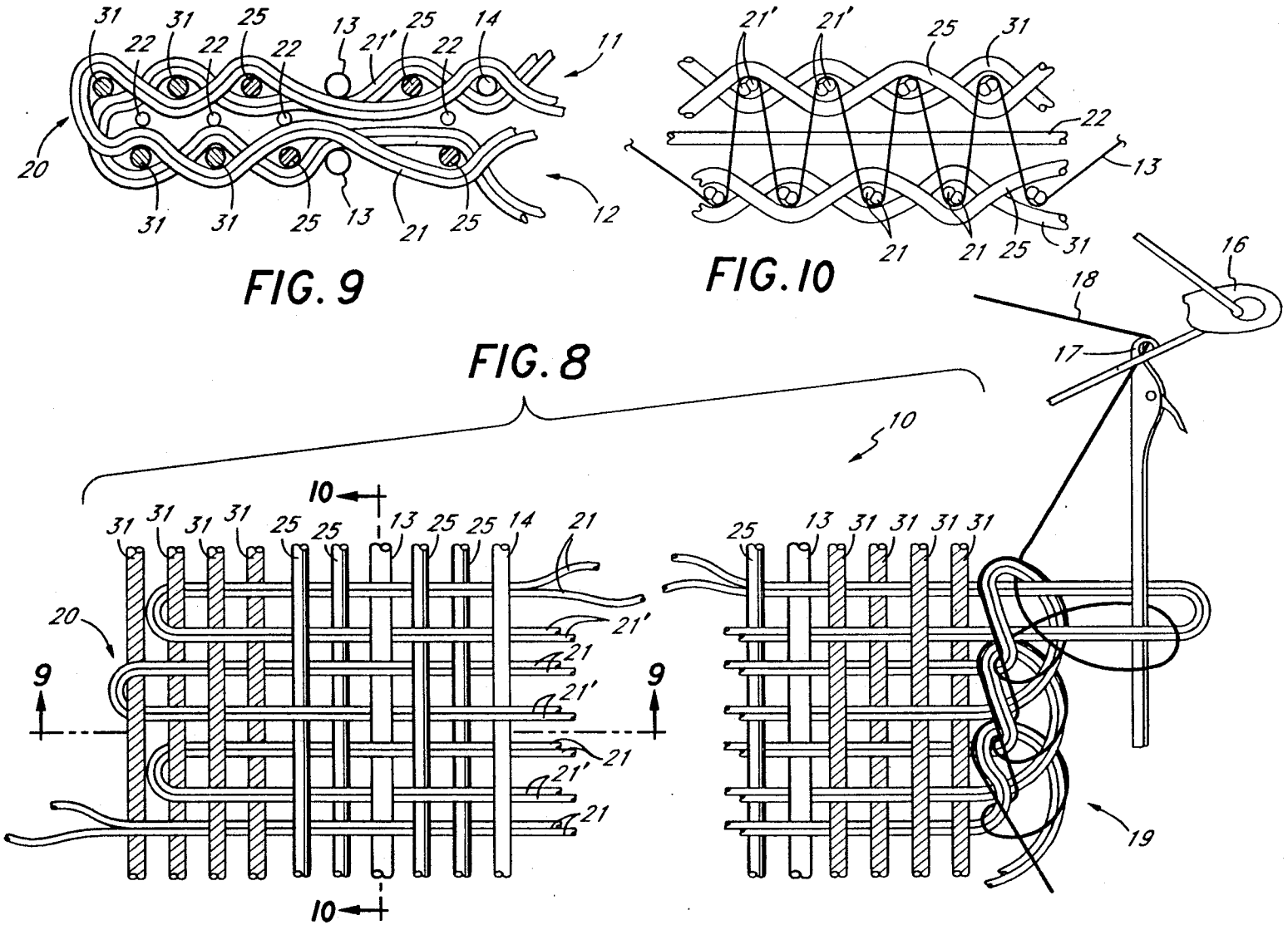
FIG. 8 is a modified version of the present invention shown in a double plain weave webbing with stuffers and binders.
FIG. 9 is a cross-sectional view taken along line 9—9 of FIG. 8.
FIG. 10 is a cross-sectional view taken along line 10—10 of FIG. 8.

It has also been discovered that by making the selvage edges of monofilament nylon that the tendency of the edges to fray is reduced. This construction is shown in FIG. 8, FIG. 9 and FIG. 10. The reason for this is that monofilament 31 has a filament diameter at least twelve to fifteen times larger than the individual fibers that make up nylon or polyester yarn. Thus, clearly, the monofilament 31 would not have the same tendency to fray as many much smaller fibers which make up the edges of typical webbing construction. This lack of fraying gives the edges a more slippery feel which reduces the catching of the selvage edges against a sharp object. When combined with the nylon yarn 25, as shown in FIGS. 8, 9 and 10, the resulting webbing is especially durable. Again one monofilament 31 in the upper fabric at each selvage edge and one monofilament 31 in the lower fabric at each selvage edge is useful, but two or more are preferred. An especially preferred construction is two monofilament warp ends 31 and two nylon yarns 25 at the upper fabric at each selvage edge and at the lower fabric at each selvage edge for a total of sixteen nylon yarns along the length of the webbing. The nylon yarns may be twisted or without twist or texturized.

Thus, the combination of monofilament nylon edges with nylon yarn warp ends adjacent the monofilament edges with a body of polyester provides excellent resistance against abuses when the webbing is under stress, but still maintains the advantage of less elongation of the polyester. The term "multiple weave" is intended to mean two or more woven layers from the bottom to the top of the fabric. The drawings show webbing with two layers (double weave) but more than two layers are also useful in the practice of the present invention.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. Woven webbing of the type having multiple weave construction having at least an upper layer of body fabric and at least a lower layer of body fabric, a first selvage edge and a second selvage edge adjacent said layers of body fabric said layers of body fabric being fabricated from polyester warp and filling yarns and having binders joining the at least one upper layer and at least one lower layer, and at least one warp yarn of nylon yarn adjacent the first and second selvage edges of the upper layer of body fabric and the lower layer of body fabric to provide greater toughness at the edges.

2. The woven webbing of claim 1 wherein there are two nylon warp yarns in the upper layer of body fabric adjacent the first selvage edge, two nylon yarns in the upper layer of body fabric adjacent the second selvage edge, two nylon yarns in the lower layer of body fabric adjacent the first selvage edge and two nylon yarns in the lower layer of body fabric adjacent the second selvage edge.

3. The woven webbing of claim 2 further including at least one monofilament warp filament between the selvage edges and the nylon yarns at each of the upper and lower layers of body fabric at the first and second selvage edges.

4. The woven webbing of claim 3 wherein there are two nylon monofilament filaments at each of the upper and lower layers of body fabric at the first and second selvage edges.

* * * * *